US006536632B2

(12) United States Patent
Bilskie et al.

(10) Patent No.: US 6,536,632 B2
(45) Date of Patent: Mar. 25, 2003

(54) BOTTLE AND BOTTLE COUPLER

(75) Inventors: Richard Bilskie, Newnan, GA (US); Harold F. Stover, Grantville, GA (US)

(73) Assignee: SP Partnership, Newman, GA (US)

( * ) Notice: Subject to any disclaimer, the term of this patent is extended or adjusted under 35 U.S.C. 154(b) by 0 days.

(21) Appl. No.: 09/848,924

(22) Filed: May 3, 2001

(65) Prior Publication Data

US 2001/0045438 A1 Nov. 29, 2001

Related U.S. Application Data

(60) Provisional application No. 60/201,638, filed on May 3, 2000.

(51) Int. Cl.[7] ..... B65D 83/00

(52) U.S. Cl. ..... 222/400.7; 222/153.09; 222/519

(58) Field of Search ..... 222/67, 129.2, 222/136, 153.09, 400.7, 519

(56) References Cited

U.S. PATENT DOCUMENTS 4,982,879 A * 1/1991 Corrado et al. ..... 222/400.7
5,152,437 A 10/1992 Klein et al. ..... 222/400.7
5,862,961 A * 1/1999 Motta et al. ..... 222/400.7
5,897,037 A * 4/1999 Mann ..... 222/519
5,957,328 A * 9/1999 Osgar ..... 222/400.7
6,216,913 B1 4/2001 Bilskie et al. ..... 222/67
6,279,782 B1 * 8/2001 Hanson ..... 222/153.09

* cited by examiner

*Primary Examiner*—Henry C. Yuen
*Assistant Examiner*—Thach Bui
(74) *Attorney, Agent, or Firm*—Thomas, Kayden, Horstemeyer & Risley, LLP

(57) ABSTRACT

The present disclosure relates to a container and a coupler adapted to receive and connect with the container. The coupler comprises a body that defines an internal passage adapted to deliver fluid to an interior space of the container, and a supply passage that is in fluid communication with the internal passage such that fluid can be delivered to the internal passage through the supply passage, and a locking member that is adapted to engage a locking groove of the container so as to securely hold the container in place within the coupler.

28 Claims, 7 Drawing Sheets

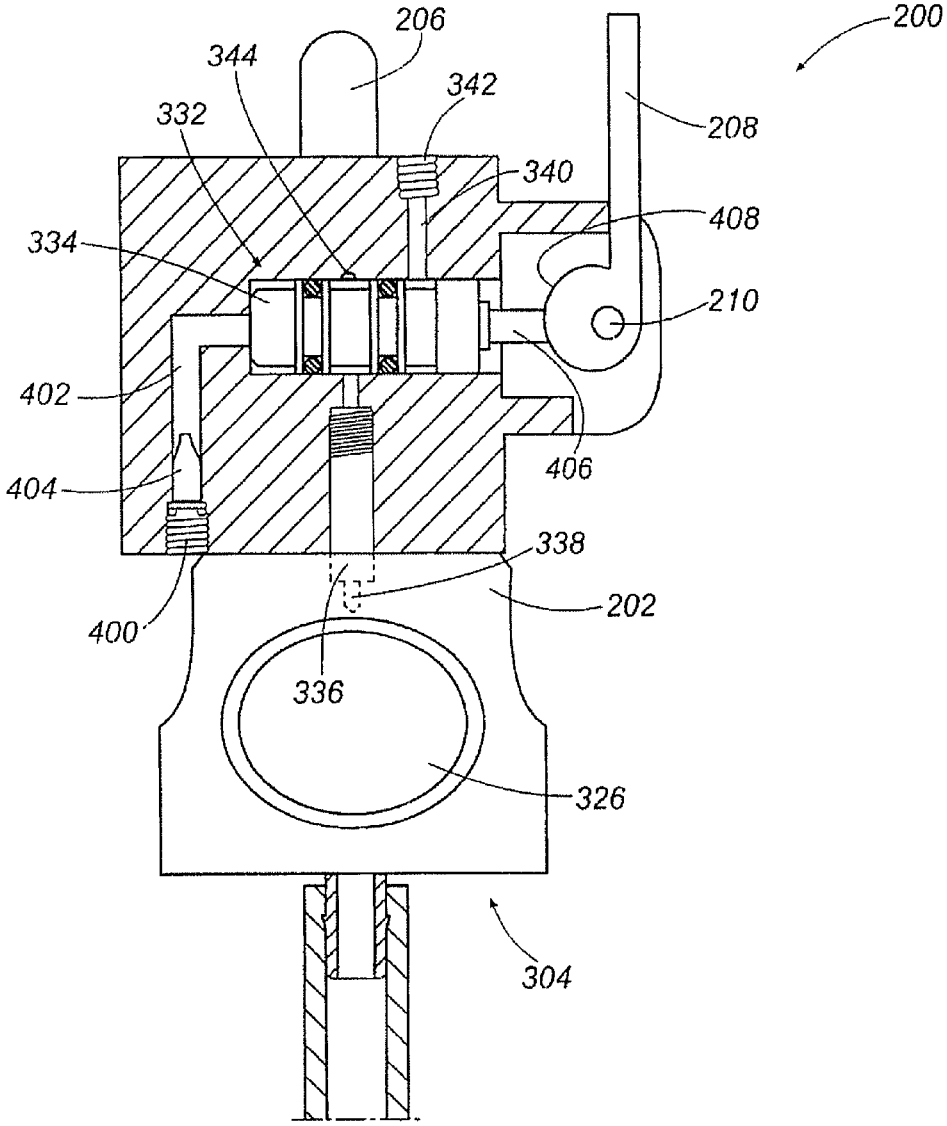
Fig. 4
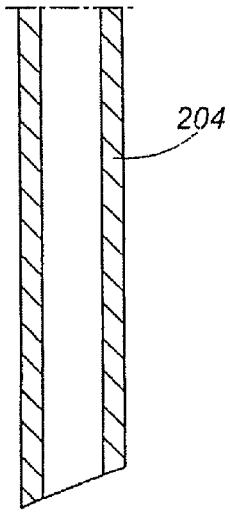

BOTTLE AND BOTTLE COUPLER

CROSS-REFERENCE TO RELATED APPLICATION

The present application claims the benefit of the filing date of U.S. Provisional Patent Application Serial No. 60/201,638, filed May 3, 2000.

FIELD OF THE INVENTION

The present disclosure relates to a bottle and a bottle coupler. More particularly, the disclosure relates to a bottle having a particular bottle finish and a bottle coupler that is adapted to receive and secure the bottle, the coupler further being adapted to pressurize the bottle such that liquid contained within the bottle can be forced out from the bottle.

BACKGROUND OF THE INVENTION

Recently, portable beverage dispensing systems have been developed that operate under the power of a driving fluid such as carbon dioxide ($CO_2$) gas. One such system is disclosed in U.S. Pat. No. 6,216,913 ("the '913 patent") issued to Bilskie et al. As indicated in that patent, the beverage dispensing system can include a plurality of liquid containers (e.g., bottles) that are used to store liquids (e.g., soft drink syrups, juice concentrates, etc.) which are used to produce mixed beverages.

As is also indicated in that patent, these containers can be housed in an inverted orientation within a cart suitable for use on a passenger vehicle such as an airplane. Although the system shown in the '913 patent works adequately well, it would be desirable to have a bottle and bottle coupler which permit upright storage of the bottles.

SUMMARY OF THE INVENTION

The present disclosure relates to a container that is adapted to connect to a coupler. The container comprises a top end and a bottom end, a body that defines an interior space, and a finish connected to the body, the finish including an opening that provides access to the interior space and including a tapered portion adjacent the top end and a locking groove adjacent the tapered portion, the locking groove being adapted to receive a locking member of the coupler.

The present disclosure also relates to a coupler adapted to receive and connect with a container. The coupler comprises a body that defines an internal passage adapted to deliver fluid to an interior space of the container, and a supply passage that is in fluid communication with the internal passage such that fluid can be delivered to the internal passage through the supply passage, and a locking member that is adapted to engage a locking groove of the container so as to securely hold the container in place within the coupler.

The features and advantages of the invention will become apparent upon reading the following specification, when taken in conjunction with the accompanying drawings.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

FIG. 4 is a partial cross-sectional front view of the bottle coupler shown in FIGS. 2 and 3, depicting a "gas off" orientation.

DETAILED DESCRIPTION

Figure 1:
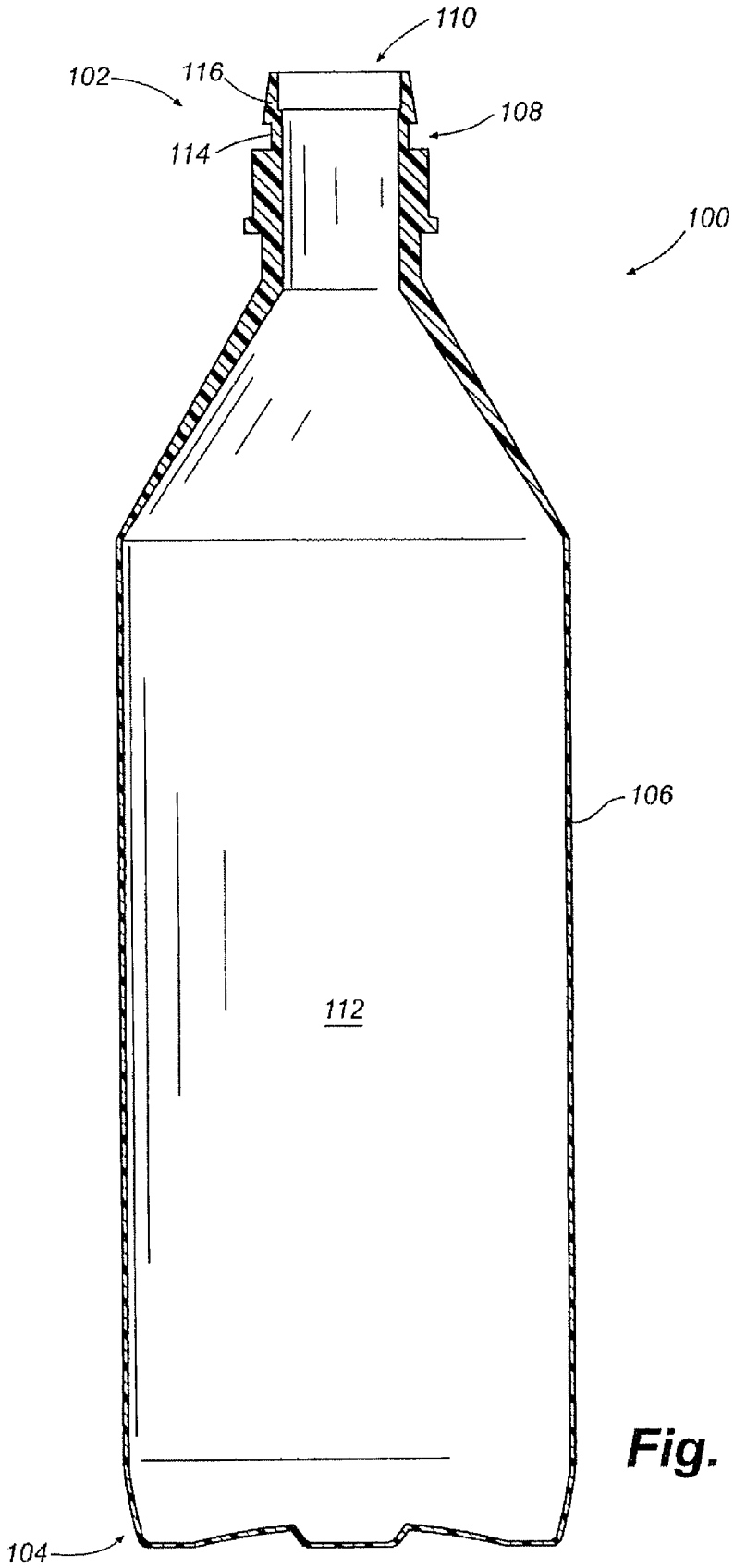
FIG. 1 is a cross-sectional side view of a bottle.

Referring now in more detail to the drawings, in which like numerals indicate corresponding parts throughout the several views, FIG. 1 illustrates a container, i.e., bottle, 100 that typically is composed of a polymeric material and which has a top end 102 and a bottom end 104. As indicated in FIG. 1, the bottle 100 generally comprises a body 106 that is used to contain liquid, such as a syrup or concentrate, and a finish 108 that, as is described in greater detail below, is used to connect the bottle to a bottle coupler. Provided at the top end 102 of the bottle 100 adjacent the finish 108 is an opening 110 through which an interior space 112 of the bottle can be accessed. As will be understood by persons having ordinary skill in the art, the configuration of the finish 108 depends upon the configuration of the bottle coupler for which the bottle 100 is intended. In one arrangement, however, the finish 108 includes a substantially continuous locking groove 114 as well as a substantially continuous tapered portion 116, the purpose for both being explained below.

Figure 2:
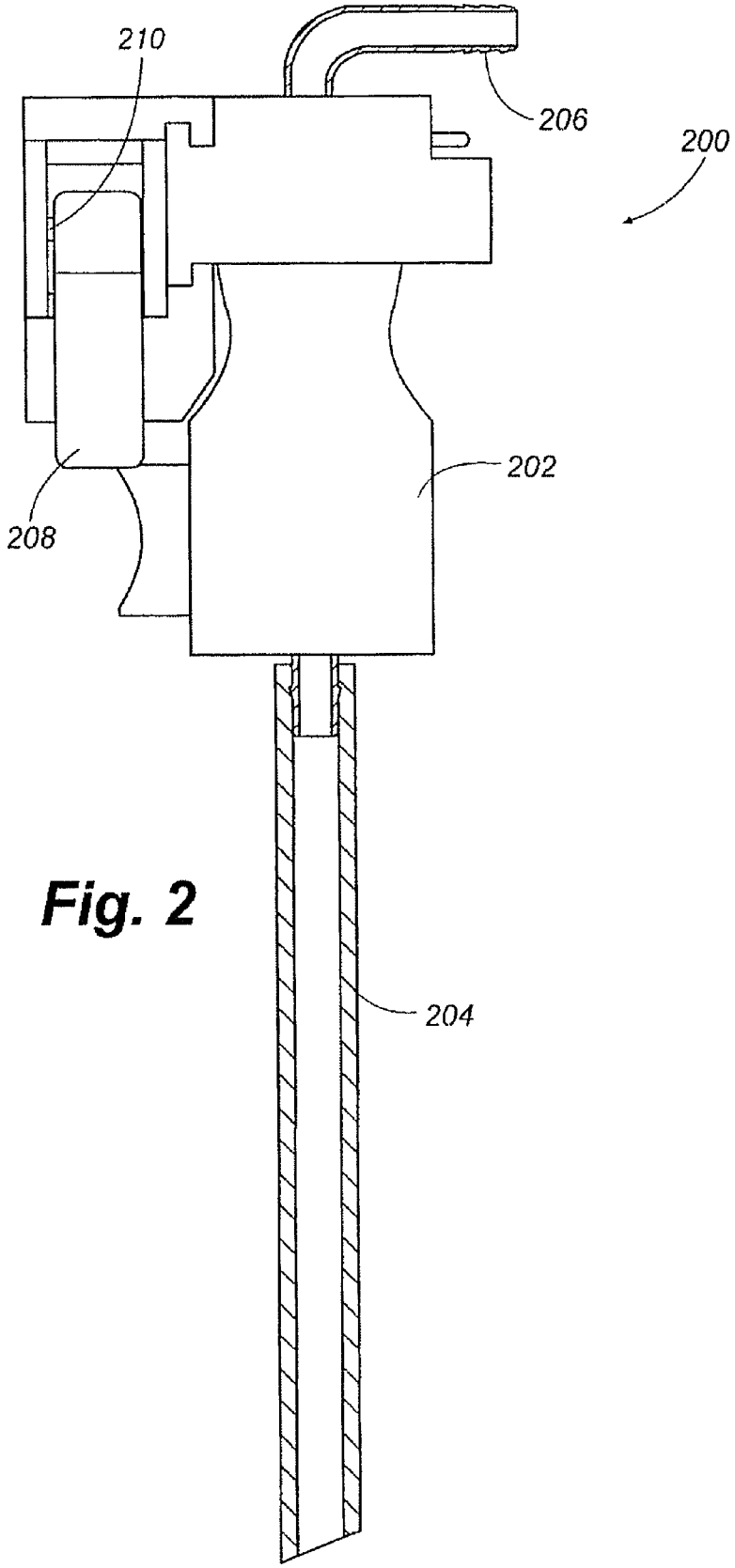
FIG. 2 is a partial cross-sectional side view of a bottle coupler adapted for use with the bottle shown in FIG. 1.

FIG. 2 illustrates a bottle coupler 200 that is adapted for use with the bottle 100 shown in FIG. 1. As indicated in FIG. 2, the bottle coupler 200 generally comprises a body 202, a liquid pick-up tube 204, and a liquid outlet tube 206. The liquid pick-up tube 204 is used to transport liquid from the interior space 112 of a bottle 100 connected to the bottle coupler 200 to the liquid outlet tube 206. As is described in the discussions that follow, the liquid is forced through the pick-up tube 204 and outlet tube 206 under pressure of a driving fluid such as a driving gas (e.g., carbon dioxide ($CO_2$)) that is supplied to the interior space 112 through the body 202 of the bottle coupler 200. Further identified in FIG. 2 is a gas control lever 208 that can be pivoted about a pin 210 (upwardly and downwardly in FIG. 2). As its name suggests, the gas control lever 208 is adapted to control the flow of gas through the bottle coupler body 202 and, therefore, into the bottle 100 that is attached thereto (see FIG. 6). This gas control lever 208 is shown in the down (i.e., "gas on") position in FIG. 2. The operation of the gas control lever 208 is described in greater detail below.

Figure 3:
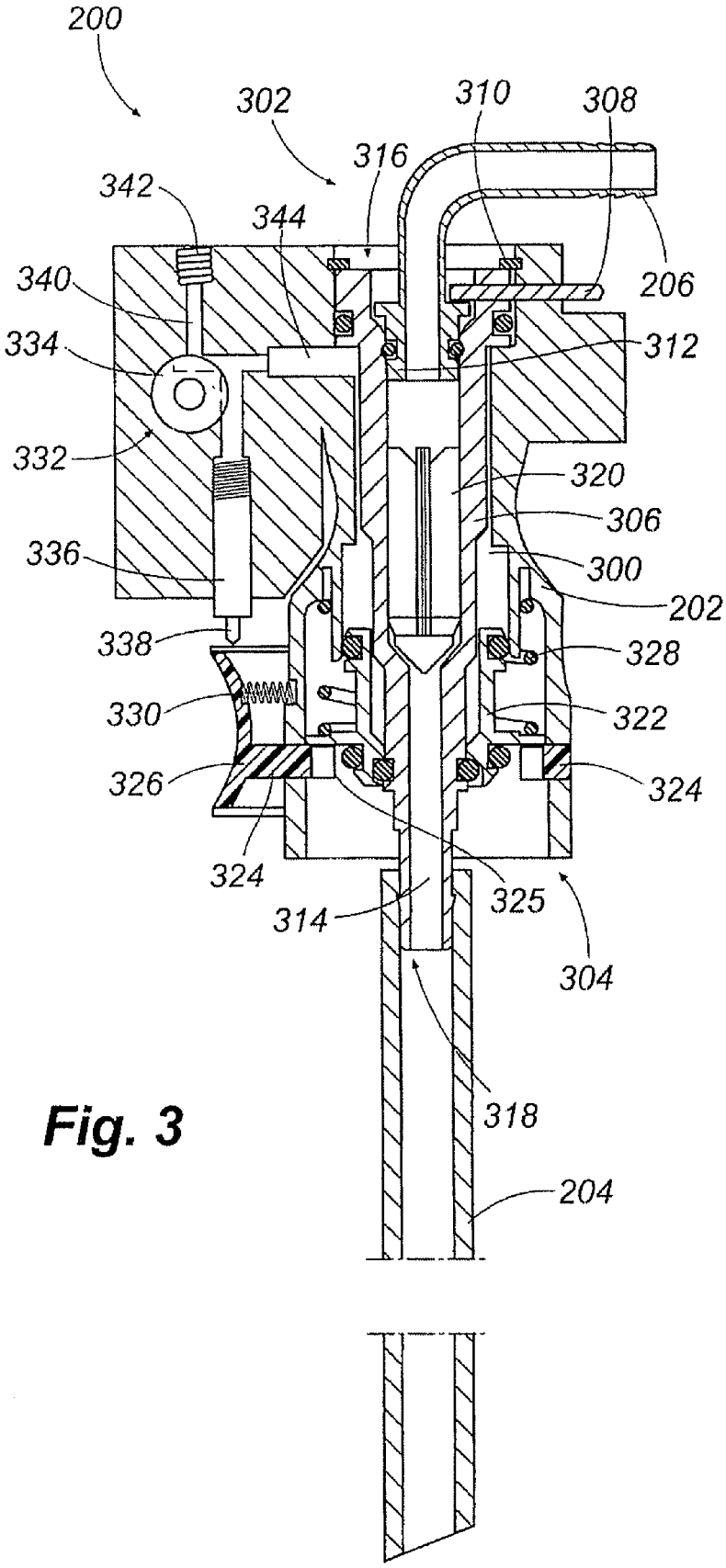
FIG. 3 is a full cross-sectional side view of the bottle coupler shown in FIG. 2.

FIG. 3 is a full cross-sectional side view of the bottle coupler 200 and therefore illustrates the internal passages and components of the bottle coupler body 202. Because the bottle coupler 200 is shown in full cross-section, the gas control lever 208 and its pin 210 are not visible in FIG. 3. As indicated in FIG. 3, the body 202 includes an internal passage 300 that extends from a top end 302 of the body to a bottom end 304 of the body. Disposed within the internal passage 300 is a central tube 306 that is supported by the interior surfaces of the internal passage 300 and which can be secured in place with a retaining pin 308 and a snap ring 310. As indicated in FIG. 3, the retaining pin 308, when used, can further secure a connector portion 312 of the liquid outlet tube 206. The central tube 306 is typically elongated so as to extend along nearly the entirety of the internal passage 300 of the bottle coupler body 202. The central tube 306 also includes an internal passage 314 that extends from a top end 316 to a bottom end 318 of the central tube. Typically, disposed within the internal passage 314 is a check member 320 that prevents the back flow of liquid through the liquid pick-up tube 204 and, therefore, into the interior space 112 of a bottle 100. As shown in FIG. 3, the liquid pick-up tube 204 is connected to the bottom end 318 of the central tube 306.

Surrounding the central tube 306 within the interior passage 300 of the bottle coupler body 202 is a sealing member 322 that is used to form a seal about a bottle 100 prior to its pressurization. As indicated in FIG. 3, the sealing member 322 is biased against a locking member such as a slide plate 324 that forms part of a bottle release button 326. Normally, this biasing is provided by a spring 328 that abuts against the interior surfaces of the internal passage 300 of the bottle coupler body 202 at one end, and against the sealing member 322 at the other. As is described in more detail below, the sealing member 322 can be urged upwardly away from the slide plate 324 within the internal passage 300, against the force of the spring 328, when the top end 102 of a bottle 100 is urged up into the bottle coupler body 202. When this occurs, the slide plate 324 is urged to the side (to the right in FIG. 3), against the force of another spring 330 that acts on the bottle release button 326, by the tapered portion 116 of the bottle 100 (FIG. 1) until the entire tapered portion passes through an oblong opening 325 of the slide plate. At this point, the slide plate 324 snaps back (to the left in FIG. 3) under the force of the spring 330 into the locking groove 114 of the bottle 100 to secure the bottle in place (see FIG. 5).

With further reference to FIG. 3, the bottle coupler body 202 also includes a valve cavity 332 in which is disposed a gas control valve 334 that is used to control the flow of gas through the bottle coupler 200 and to a bottle 100. The configuration and operation of the gas control valve 334 is described in greater detail below in relation to FIGS. 4–6. As indicated in FIG. 3, the valve cavity 332, and therefore the gas control valve 334, is in fluid communication with a locking mechanism 336 that can be used to lock the bottle release button 326 such that it cannot be depressed to release a bottle. As described below, this locking feature is provided as a safety measure to avoid release of a bottle 100 when it is still pressurized by the driving fluid. Normally, the locking mechanism 336 includes a locking needle 338 that, as indicated in FIG. 3, is biased towards a retracted position in which the needle does not interfere with operation of the bottle release button 326.

The valve cavity 332 is further in fluid communication with a vent passage 340 that leads to a vent port 342. As described below, the vent passage 340 and vent port 342 are used to vent gas from the bottle 100 and bottle coupler 200 when the gas is shut off and the bottle is to be removed. Also in fluid communication with the valve cavity 332 is a gas supply passage 344 that, as indicated in FIG. 3, leads to the internal passage 300 of the bottle coupler body 202. As is described below, gas supplied to the bottle coupler 200 can be delivered from the gas control valve 334, through the gas supply passage 344, through the internal passage 300, and into a bottle 100 connected to the bottle coupler 200 to cause liquid contained within the bottle to flow up through the liquid pick-up tube 204. Also shown in FIG. 3 are various gaskets (e.g., O-rings) that have not been identified with reference numerals but which are normally used to form various seals within the bottle coupler 200.

FIG. 4 is a partial cross-sectional front view of the bottle coupler 200 and, more particularly, the means with which gas is delivered through the bottle coupler. As indicated in FIG. 4, the bottle coupler 200 includes a gas inlet 400 to which an external gas supply line (not shown) can be connected to supply the bottle coupler 200 with driving gas. The gas inlet 400 is in fluid communication with an inlet passage 402 that leads to the valve cavity 332 first identified in FIG. 3. Typically, a check valve 404 is disposed within the inlet passage 402 to prevent the back flow of gas out from the gas inlet 400. As indicated in FIG. 4, the gas control valve 334 can be arranged as a normally open, three-way valve that is configured to deliver gas to the gas supply passage 344 and the locking mechanism 336, or to shut off the supply of gas and permit any gas within the bottle 100 and the bottle coupler 200 to escape through the vent port 342. In FIG. 4, the gas control valve 334 is shown in the closed position (i.e., "flow off") in which gas flow is shut off. Because the gas is shut off, the locking needle 338 of the locking mechanism 336 is biased to the retracted position and the bottle release button 326 can be depressed (i.e., moved to the right in FIG. 3).

The operation of the gas control valve 334 is controlled with a valve needle 406. In contrast to the locking needle 338 of the locking mechanism 336, the valve needle 406 is biased toward an extended (i.e., "flow on") position (see FIG. 5). In the extended position, gas is permitted to flow to the gas supply passage 344 and the locking mechanism 336. As indicated in FIG. 4, however, the valve needle 406 has been displaced to a retracted position (to the left in FIG. 4) by a cam surface 408 of the gas control lever 208. Such displacement occurs when the gas control lever 208 is in the up (i.e., "flow off") position indicated in FIG. 4.

Figure 5:
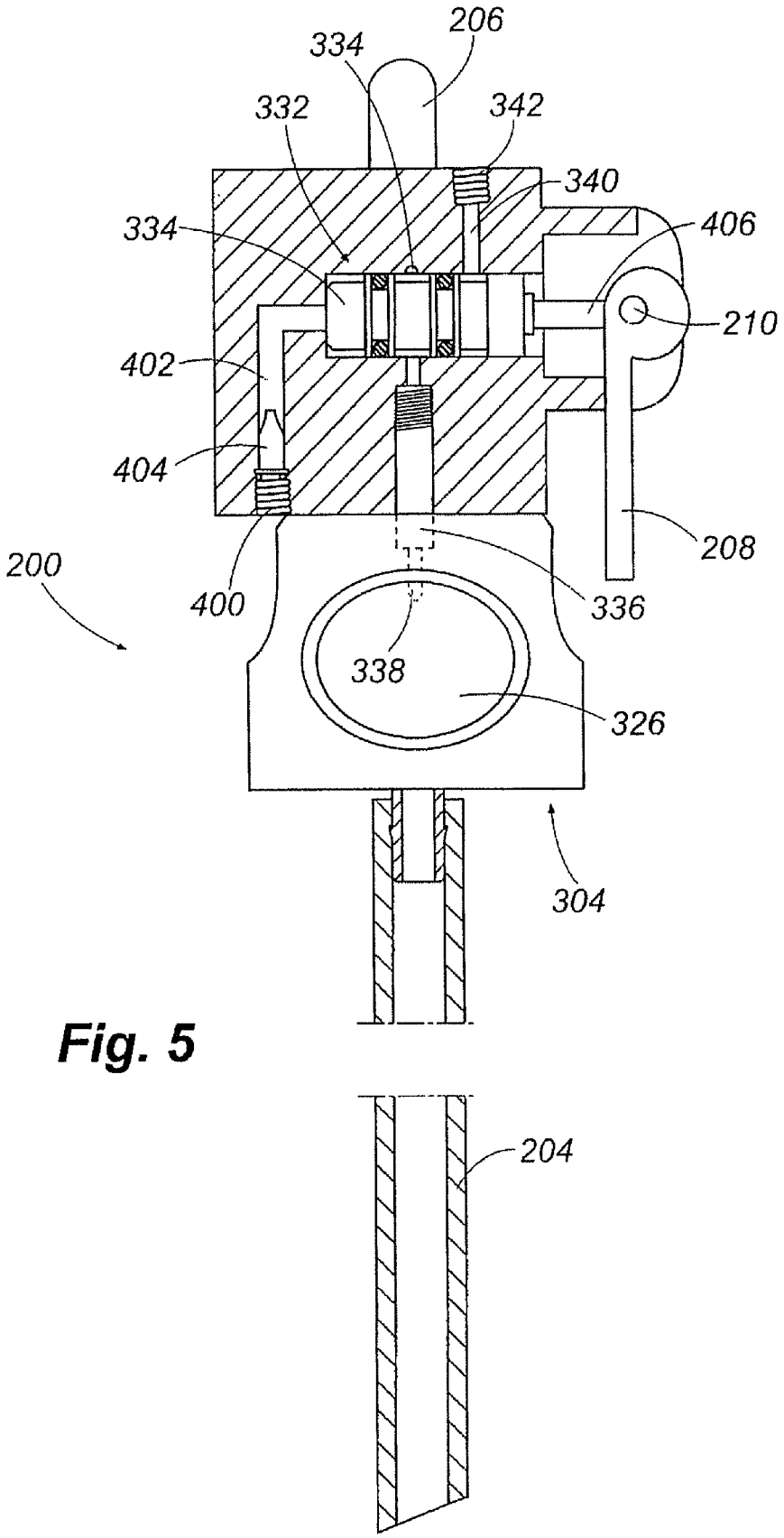
FIG. 5 is a partial cross-sectional front view of the bottle coupler shown in FIGS. 2–4, depicting a "gas on" orientation.

The primary components of the bottle 100 and bottle coupler 200 having been described above, the operation and use of the bottle and bottle coupler will now be discussed in reference to FIGS. 4–6. Referring first to FIG. 4, the bottle coupler 200 is shown in the "flow off" orientation, i.e., with the gas control lever 208 in the up position and the value needle 406 depressed to the retracted position. As described above, this orientation results in the flow of gas to the gas supply passage 344 and the locking mechanism 336 being shut off and the passages within the bottle coupler 200 being vented to the atmosphere. While in this orientation, the bottle coupler 200 is prepared for receipt of a bottle 100 so that liquid contained within the bottle can be dispensed with the bottle coupler. A filled bottle 100 can therefore be inserted into the internal passage 300 of the bottle coupler body 202 at its bottom end 304. In particular, the liquid pick-up tube 204 can be inserted into the interior space 112 of the bottle 100 through the bottle opening 110, and the top end 102 of the bottle urged up into the bottle coupler body 202. When urged into the coupler body 202, the bottle finish 108, and more specifically the tapered portion 116, urges the slide plate 324 to the side (to the right in FIG. 3) against the biasing force of the spring 330. Insertion of the bottle 100 into the coupler body 202 continues until the entire tapered portion 116 passes through the opening 325 of the slide plate 324, at which time the slide plate snaps back under the force of the spring 330 into the locking groove 114 to securely lock the bottle in place.

Once the bottle 100 is secured to the bottle coupler 200 in the manner described above, it is prepared for pressurization. As mentioned above, the gas inlet 400 of the bottle coupler 200 can be connected to an external gas supply line (not shown) which provides the driving gas to the coupler. When the gas control lever 208 is moved to the down (i.e., "flow on") position shown in FIG. 5, the valve needle 406 is urged to an extended position and the gas control valve 334 is switched to the on position in which gas can flow to the gas supply passage 344 and the locking mechanism 336. As indicated in FIG. 5, the gas that flows to the locking mechanism 336 causes the locking needle 338 to be urged outwardly to an extended position indicated in FIGS. 5 and 6, so as to prevent the bottle release button 326 from being depressed. Accordingly, the locking mechanism 336 serves as a safety measure that prevents persons from releasing the bottle 100 while it is still under pressure.

Figure 6:
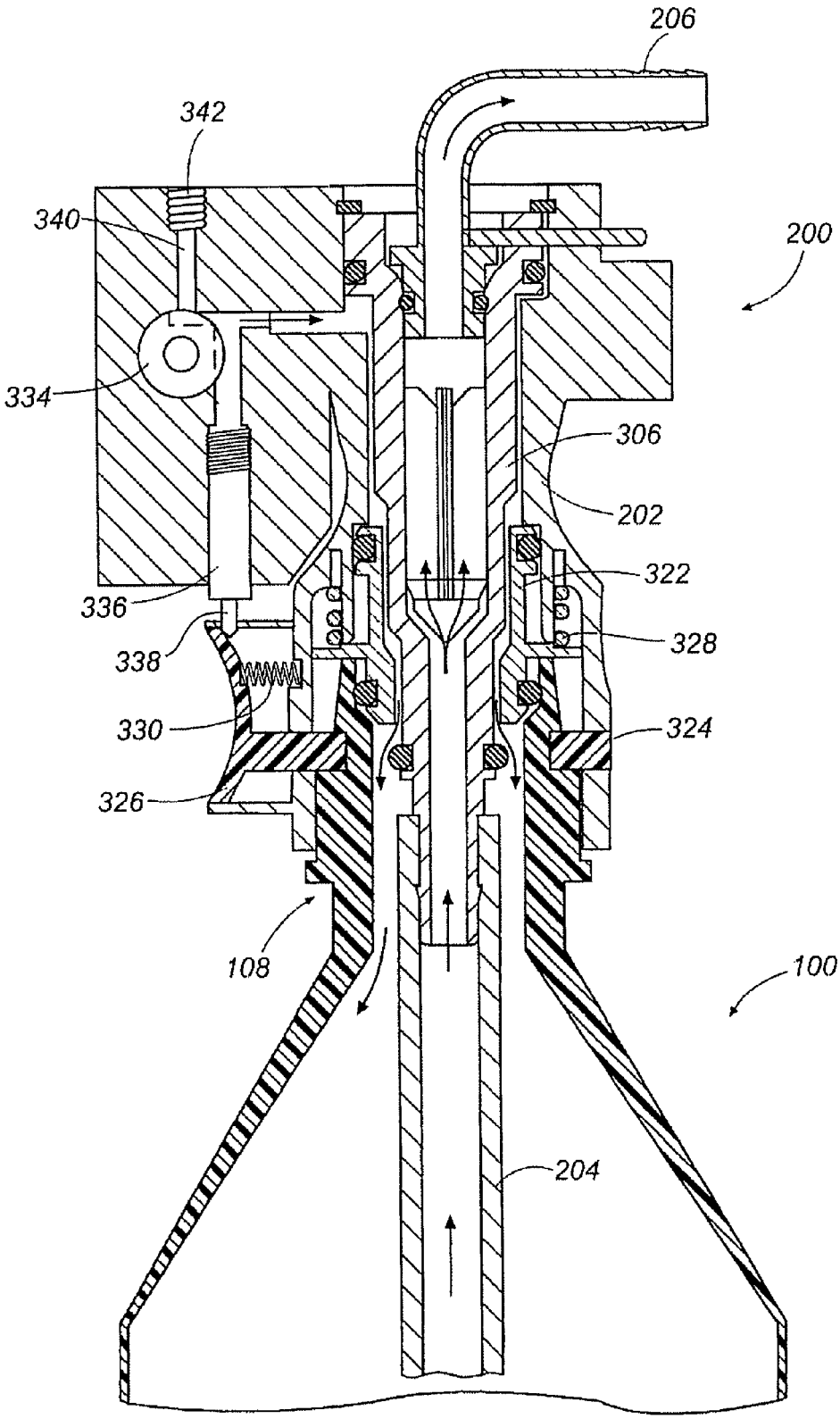
FIG. 6 is a partial, cross-sectional side view of the bottle shown in FIG. 1 connected to the bottle coupler shown in FIGS. 2–5.

With reference now to FIG. 6, which illustrates a bottle 100 connected to the bottle coupler 200 while the coupler is in the "flow on" orientation, gas can flow through the gas supply passage 344, as indicated by the directional arrow, and into the internal passage 300 along the exterior surfaces of the central tube 306. Due to the provision of the various gaskets of the central tube 306, the gas flows downwardly along the internal passage 300, as indicated by the directional arrows, and between the sealing member 322 and the central tube 306. Because the sealing member 322 has been urged upwardly against the force of the spring 328, the seal between the sealing member and the central tube 306 is broken, thereby permitting gas to flow into the bottle 100, as indicated by the directional arrows. Therefore, the gas is free to pass into the bottle 100 to pressurize the interior space 112 of the bottle and any liquid contained therein.

Due to this pressurization, liquid will be forced up through the liquid pick-up tube 204, as indicated by the directional arrows, whenever the flow of liquid is permitted downstream of the bottle coupler 200 (e.g., with a bar gun). Therefore, liquid can be supplied with the bottle coupler 200 via the central tube 306 and the liquid outlet tube 206 until all of the liquid has been used. At this point, the gas flow can be shut off by moving the gas control lever 208 to the up (i.e., "flow off") position so as to inhibit the flow of gas beyond the gas control valve 334 and to vent any gas remaining in the bottle 100 and the bottle coupler 200 to the atmosphere via the vent passage 340 and the vent port 342. Then, the empty bottle 100 can be released by depressing the bottle release button 326 (which is now free to move due to retraction of the locking needle 338), and the bottle can be ejected from the bottle coupler 200 under the force of the spring 328.

Figure 7:
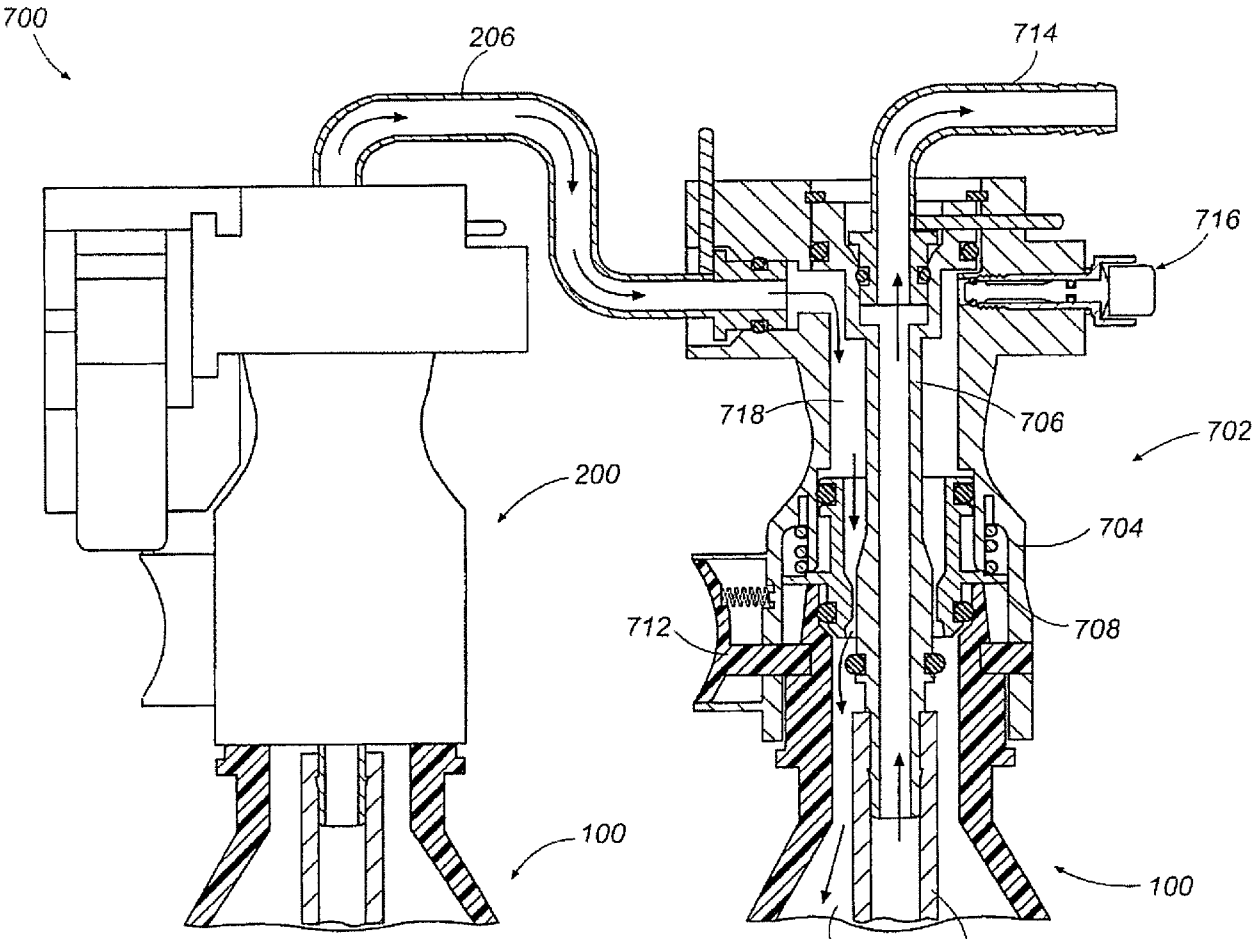
FIG. 7 is a partial, cross-sectional side view of a high capacity system that uses the bottle shown in FIG. 1 and the bottle coupler shown in FIGS. 2–5.

FIG. 7 is a partial, cross-sectional side view of a high capacity system 700 that uses the bottle 100 shown in FIG. 1 and the bottle coupler 200 shown in FIGS. 2–5. In this system 700, the bottle coupler 200 is used with a first bottle 100 and a second, alternative bottle coupler 702 is used with a second bottle 100. The first bottle coupler 200 includes a liquid outlet tube 206 that connects to the second bottle coupler 702 and acts as a supply tube for the second bottle coupler. The configuration of the second bottle coupler 702 is similar to that of the first. Accordingly, the second bottle coupler 702 can include a body 704, a central tube 706, a sealing member 708, a liquid pick-up tube 710, a bottle release button 712, and a liquid outlet tube 714, each of which is configured and used in similar manner to the like-named components described above in relation to the first bottle coupler 200. In addition, however, the second bottle coupler 702 includes a venting mechanism 716, the purpose for which is described below.

Operation of the system 700 is similar to that described above for the bottle 100 and bottle coupler 200 provided above. Accordingly, gas is supplied to the first bottle coupler 200 to drive liquid out from the coupler through the liquid outlet tube 206. In the system 700 shown in FIG. 7, however, the liquid output from the first bottle coupler 200 is used as the driving fluid for the second bottle coupler 702. Therefore, this liquid flows into the second bottle coupler 702 through the liquid outlet tube 206, as indicated with the directional arrows, and into an internal passage 718 of the second bottle coupler body 704 so that the liquid can flow between the central tube 706 and the sealing member 708 into the interior space 112 of the second bottle 100 connected thereto. In that the: liquid is under pressure, it forces the liquid contained within the second bottle 100 up through the liquid pick-up tube 710 and ultimately out through the liquid outlet tube 714.

With the arrangement shown in FIG. 7, twice as much liquid can be stored and dispensed. As will be apparent to persons having ordinary skill in the art, multiple bottle couplers can be arranged in series in the manner shown in FIG. 7 to further increase capacity, if desired. Once the liquid from both bottles 100 shown in FIG. 7 is substantially depleted, one or more of the bottles can be replaced with full bottles, if desired. Where only the first bottle 100 is removed and replaced, the venting mechanism 716 can be used to evacuate gas that has been delivered from the first bottle coupler 200 into the second bottle 100 so that the second bottle can again be filled with liquid.

While particular embodiments of the invention have been disclosed in detail in the foregoing description and drawings for purposes of example, it will be understood by those skilled in the art that variations and modifications thereof can be made without departing from the spirit and scope of the invention as set forth in the following claims. For example, although "gas" is identified as the preferred driving fluid, it is to be appreciated that, as shown in FIG. 7, substantially any fluid could be used as the driving fluid, if desired. In addition, although particular default settings (e.g., normally open) have been described, persons having ordinary skill in the art will appreciate that such settings can be changed and yet the functionality disclosed herein can still be obtained.

What is claimed is:

1. A coupler adapted to receive and connect with a container, the coupler comprising:

a body that defines an internal passage adapted to deliver fluid to an interior space of the container, and a supply passage that is in fluid communication with the internal passage such that fluid can be delivered to the internal passage through the supply passage;

a locking member that is adapted to engage a locking groove of the container so as to securely hold the container in place within the coupler; and a sealing member that is adapted to seal about the container, the sealing member being biased so as to be urged against the container when it is received within the coupler.

2. The coupler of claim 1, further comprising a pick-up tube that is adapted to deliver fluid out from the interior space of the container.

3. The coupler of claim 2, further comprising an outlet tube that is adapted to deliver fluid from the coupler.

4. The coupler of claim 3, further including a central tube disposed within the internal passage that is in fluid communication with the pick-up tube and the outlet tube such that fluid can be delivered by the pick-up tube to the outlet tube via the central tube.

5. The coupler of claim 1, further comprising a release button that is connected to the locking member such that the container can be inserted into or removed from the coupler when the release button is depressed.

6. The coupler of claim 5, wherein the release button is biased so as to bias the locking member such that the locking member is adapted to snap into place into the locking groove of the container.

7. The coupler of claim 1, further comprising a control valve that is used to control the flow of fluid into the supply passage and the internal passage.

8. The coupler of claim 7, wherein the control valve includes a valve needle.

9. The coupler of claim 8, further comprising a control lever that manipulates the valve needle when rotated.

10. The coupler of claim 9, wherein the locking member comprises a slide plate.

11. A bottle coupler adapted to receive and connect with a bottle, the bottle coupler comprising:

a coupler body that defines an elongated internal passage that is adapted to deliver fluid to an interior space of the bottle, a supply passage that is in fluid communication with the internal passage such that gas can be delivered to the internal passage through the supply passage, a valve cavity in fluid communication with the supply passage, and an inlet passage in fluid communication with the valve cavity through which gas from an external source can be delivered to the valve cavity;

a control valve disposed within the valve cavity, the control valve being manipulable to alternatively permit and impede the flow of gas to the supply passage;

a biased bottle release button; and a slide plate connected to the bottle release button, the slide plate being adapted to firmly engage a locking groove of the bottle so as to securely hold the bottle in place within the coupler.

12. The coupler of claim 11, further comprising a pick-up tube that is adapted to deliver liquid out from the interior space of the bottle.

13. The coupler of claim 12, further comprising an outlet tube that is adapted to deliver liquid out from the coupler.

14. The coupler of claim 13, further including a central tube disposed within the internal passage that is in fluid communication with the pick-up tube and the outlet tube such that liquid can be delivered by the pick-up tube to the outlet tube via the central tube.

15. The coupler of claim 11, further comprising a sealing member that is adapted to seal about the bottle when it is received within the coupler.

16. The coupler of claim 15, wherein the sealing member is biased so as to be urged toward the slide plate.

17. The coupler of claim 11, wherein the control valve includes a valve needle.

18. The coupler of claim 17, further comprising a control lever that manipulates the valve needle when rotated.

19. A fluid storage and dispensing system, comprising:

a first container having first and second ends and a locking groove provided adjacent the first end; and a first coupler connected to the first container, the first coupler comprising a body that defines an internal passage adapted to deliver fluid to an interior space of the first container, and a supply passage that is in fluid communication with the internal passage such that fluid can be delivered to the internal passage through the supply passage;

a outlet tube through which fluid can be delivered from the first coupler; and a locking member plate that is engages the locking groove of the container so as to securely hold the container in place within the coupler.

20. The system of claim 19, further comprising a second container and a second coupler connected to the second container, the second coupler being in fluid communication with the outlet tube of the first coupler such that fluid delivered from the first coupler is delivered to the second coupler.

21. The system of claim 20, wherein the second coupler comprises a body that defines an internal passage adapted to deliver fluid to an interior space of the second container, in the internal passage being in fluid communication with the outlet tube of the first coupler and with the interior space of the second container.

22. The system of claim 21, wherein the second coupler further comprises a locking member that is adapted to engage a locking groove of the second container so as to securely hold the second container in place within the second coupler.

23. The system of claim 20, wherein each of the first and second couplers includes a pick-up tube that delivers fluid out from the interior spaces of the first and second containers, respectively.

24. The system of claim 20, wherein the second coupler comprises an outlet tube used to deliver fluid from the second coupler.

25. The system of claim 20, wherein each of the first and second couplers includes a sealing member that seals about the first and second containers, respectively.

26. The system of claim 20, wherein the sealing members are biased so as to be urged against the first and second containers.

27. The system of claim 20, wherein the first coupler further comprises a control valve that is used to control the flow of fluid into the internal passage of the first coupler.

28. The system of claim 27, wherein the operation of the control valve is controlled with a control lever.

* * * * *

UNITED STATES PATENT AND TRADEMARK OFFICE

CERTIFICATE OF CORRECTION

PATENT NO. : 6,536,632 B2
DATED : March 25, 2003
INVENTOR(S) : Bilskie et al.

It is certified that error appears in the above-identified patent and that said Letters Patent is hereby corrected as shown below:

Title page,
Item [73], replace "SP Partnership" with -- SB Partnership --

Signed and Sealed this

Twenty-second Day of July, 2003

JAMES E. ROGAN
*Director of the United States Patent and Trademark Office*